United States Patent [19]

Albert et al.

[11] 4,009,848

[45] Mar. 1, 1977

[54] GYRO SEEKER

[75] Inventors: William Charles Albert, Boonton; Bart Joseph Zoltan, Old Tappan, both of N.J.

[73] Assignee: The Singer Company, Little Falls, N.J.

[22] Filed: Oct. 15, 1975

[21] Appl. No.: 622,561

[52] U.S. Cl. ..... 244/3.16; 74/5.1

[51] Int. Cl.[2] ..... F41G 7/00

[58] Field of Search ..... 244/3.16; 74/5.1–5.7

[56] References Cited

UNITED STATES PATENTS

| | | | |
|---|---|---|---|
| 2,963,973 | 12/1960 | Estey | 244/3.16 |
| 3,756,538 | 9/1973 | McLean | 244/3.16 |
| 3,920,200 | 11/1975 | Evans et al. | 244/3.16 |

*Primary Examiner*—Verlin R. Pendegrass
*Assistant Examiner*—Thomas H. Webb
*Attorney, Agent, or Firm*—Thomas W. Kennedy; Laurence A. Wright

[57] ABSTRACT

A gyro seeker which may be employed and housed in the nose section of a cannon launched missile. The gyro seeker functions in a dual mode in that it detects either laser designated targets or targets emitting infrared radiation. Structurally, the gyro seeker comprises a spherically shaped gyro element hydrostatically supported on a gas bearing surface within a spherical cavity of a spherically shaped platform. The gyro in turn supports optical and detector/cryostat assemblies for tracking and detecting desired targets. The platform is similarly hydrostatically supported on gas bearings within the housing. The platform is restrained on the base of the missile by a trapeze mechanism which limits the platform to two-degrees-of-freedom. Means are provided for torquing both the gyro and the platform. Additional means are provided to allow the gyro seeker to withstand the high induced acceleration forces of cannon launching.

9 Claims, 7 Drawing Figures

FIG. 1
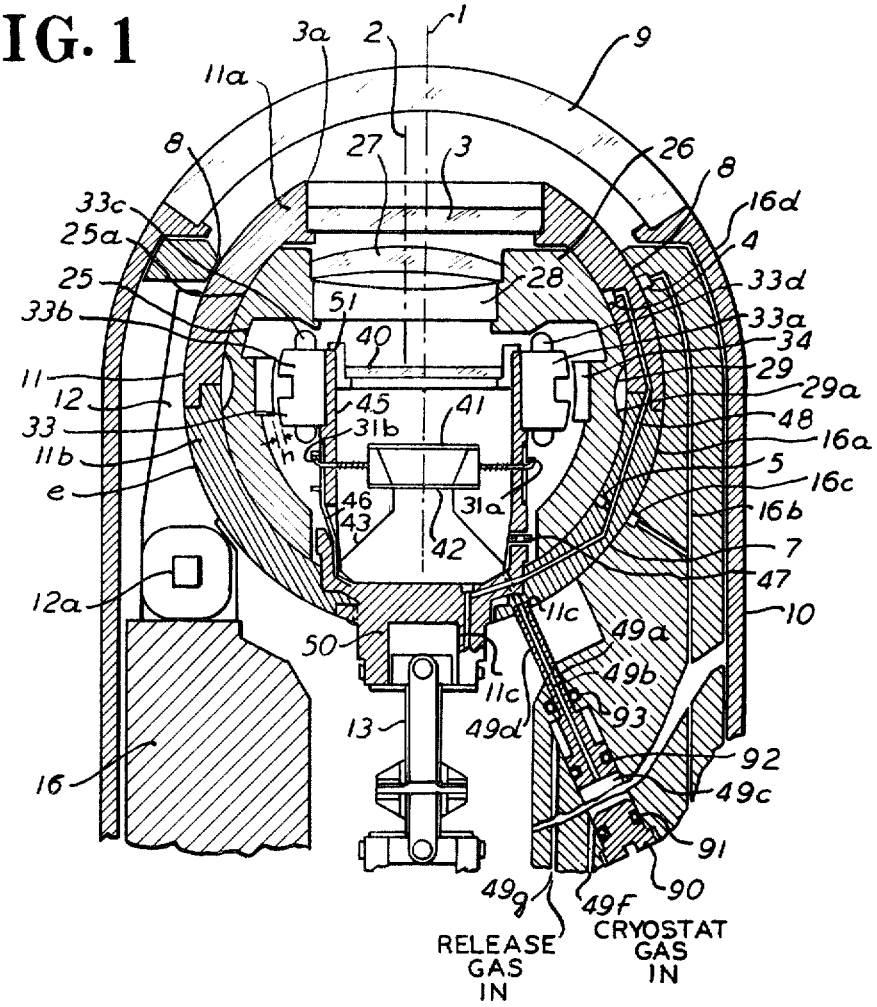
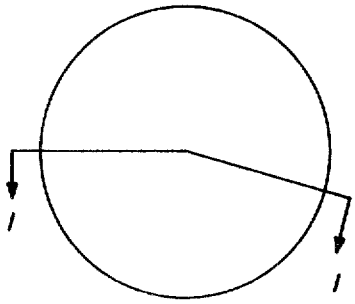
FIG. 2

FIG. 3
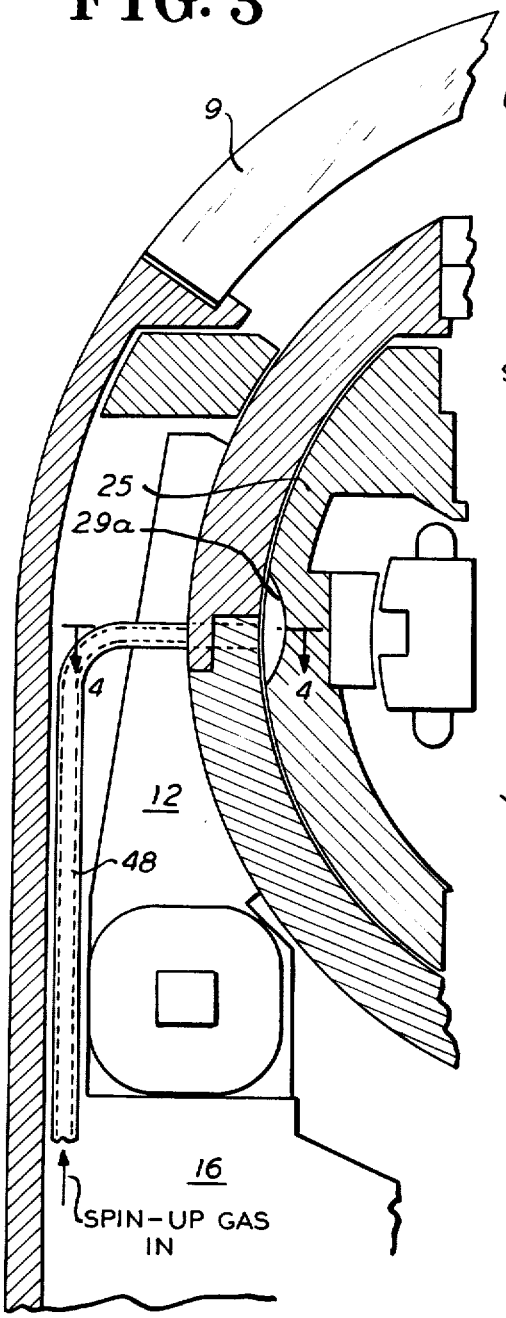
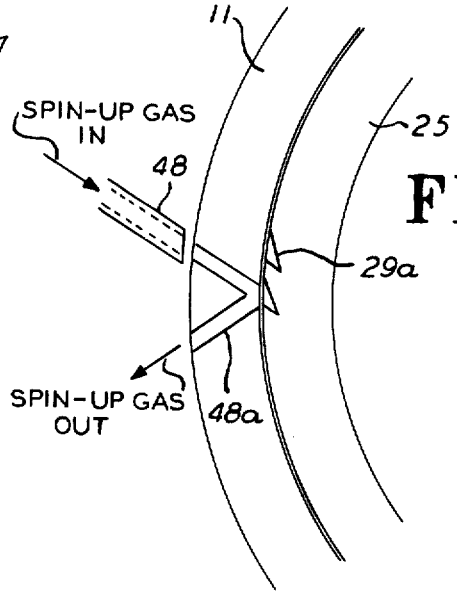
FIG. 4
FIG. 6
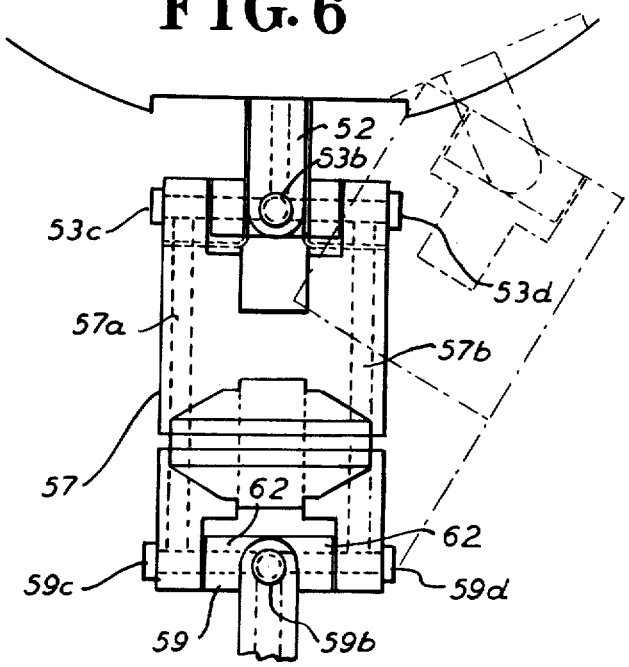

GYRO SEEKER

This invention relates to a gyroscopically stabilized optical tracking system. More particularly, the invention relates to a dual mode detection, stabilized wide angle gyro seeker which may be employed in a cannon launched missile system.

BACKGROUND OF THE INVENTION

The employment of a gyro optical system in directing a missile to a target is known to those skilled in the art. The guidance system tracks a source of radiation which may be light or infared rays and homes in on the target. Where gyro optical systems of the type described are to be employed in cannon launched missiles systems, problems arise in devising gyroscopic elements that are capable of operating over wide angular range while maintaining the image plane of the optical system parallel to the plane of the optical elements. Furthermore, means must be devised in cannon launch gyro systems that are capable of withstanding the extreme acceleration and deceleration loads inherent in cannon launching. Failure to maintain the optical system parallel to the image plane results in degradation of the optical signal and failure to build in means to withstand high induced acceleration forces may result in total failure of the gyro device.

A unique gyroscopic device is disclosed by the present invention which overcomes the aforementioned disadvantages. The present invention is primarily shaped by the requirements for detecting and tracking a target radiating in the 8 to 12 micron range. The present invention consistutes a two axis inertial, gyro platform. However, because of the unusual structural design concept, the benefits of platform isolation are afforded without the usually attendant penalties in cost and weight.

The present invention represents a significant improvement in performance and versatility relative to prior art gyro seekers. By virtue of its construction, the present invention is capable of accepting an optical system of better resolution and sensitivity. As a result of the inherent packaging efficiency of the design, the advantages of the present invention are achieved in a relatively small, light weight, rugged device having a long shelf life.

BRIEF DESCRIPTION OF THE INVENTION

The gyro seeker of the invention is enclosed in a housing positioned on the nose section of a missile. The housing has a transparent dome shaped window at its forward section. Within the housing are situated the optical assembly, the gyro assembly, the cryostat/ detector assembly, and the platform of the gyro seeker. The platform supports all of the above assemblies in a unique manner in order to compensate for the extreme, induced acceleration forces of cannon launching. This is accomplished by giving both the gyro element and the platform a spherical shape. The gyro element nests in the spherical cavity of the platform which reduces the effects of the acceleration forces. Moreover, the gyro rotor is mounted on air bearings within the platform cavity and this also compensates for induced acceleration forces. The optical assembly is supported by the gyro in a manner which offsets the optical longitudinal axis from the spin axis of the gyro. The cryostat is fixed to a pedestal portion of the platform and positioned interiorly of the gyro. The cryostat is also maintained perpendicular to the longitudinal axis of the optical assembly. The platform is supported on gas bearings within the housing and is limited to two-degrees-of-freedom movement by a trapeze mechanism. Means are provided to torque both the platform and the gyro and to maintain the system at platform null. The system is designed to detect either reflections from a laser designated target or infrared radiation.

Accordingly, it is an object of this invention to provide a stabilized optical seeker assembly which is capable of operating over a wide angular range.

It is another object of this invention to provide a detector assembly including a cryostat that moves with the optical system in such a manner that the detector located in the image plane remains parallel to the plane of the optics.

It is a further object of this invention to provide spherical nesting means for the spherical surfaces of the gyro element and platform to compensate for high induced acceleration forces.

It is yet a further object of this invention to provide torquing means for both the gyro rotor and platform.

These and other objects and advantages will be more readily understood by those skilled in the art after a detailed consideration of the following specifications taken in conjunction with the accompanying drawings wherein:

FIG. 1 is a cross-sectional view (not to scale), taken along the line 1—1 of FIG. 2, of the gryo seeker of the invention;

FIG. 2 is an outline plan view of the gyro seeker of FIG. 1 showing where the cross-section of FIG. 1 is taken.

FIG. 3 is a detailed view with portions illustrated in section of the passage for applying spin-up gas to the gyro rotor;

FIG. 4 is an exploded view taken along the line 4—4 of FIG. 3 showing the intake and exhaust passages for the spin-up gas;

FIG. 6 is a side elevational view of the platform trapeze mechanism; and

Figure 5:
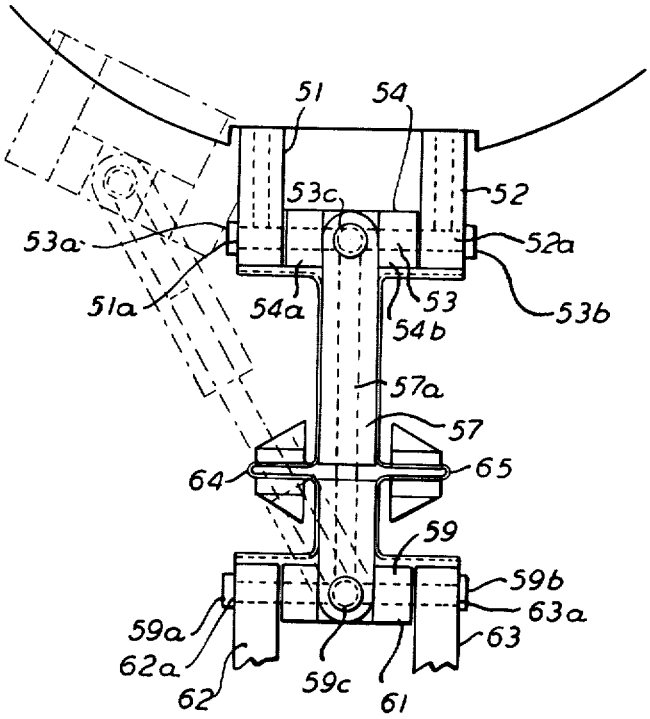
FIG. 5 is a detailed elevational view (not to scale) of the platform trapeze mechanism.

Referring to FIG. 1, numeral 10 designates a housing mounted on the nose section of a cannon launch missile. Mounted inside housing 10 on gas bearing **16*a* of base 16 is an essentially spherically shaped platform 11 which comprises an upper half 11*a* made of magnetic material and lower half 11*b* made of non-magnetic material. This use of dissimilar materials in the platform construction permits the use of simple, wide angle torquers (to be discussed below.) The two halves 11*a* and 11*b* are held together by screws (not shown) during final assembly and form an inner spherical cavity in which the gyro 25 is supported on gas bearings 25*a*. This cavity is produced by first making the cavity slightly oversized and then casting a thin layer of plastic over the surface. Each half 11*a* and 11*b* contains a number of orifices 4 and 5 near the plastic surface for insertion of gas on the rotor gas bearing surface 25*a*. There exists a pressure of about 60 psi behind each of these orifices. The base 16 contains flow passages 16*b* for conducting gas to orifices 16*c* and 16*d* needed to levitate platform 11 on gas bearing 16*a*. Platform 11 is restrained by a trapeze mechanism 13 which in turn is attached to the base 16** of the vehicle. Trapeze mechanism 13 limits platform 11 to two-degrees-of-freedom over an angular movement of ± 25°.

The exterior surface of section 11*a* of platform 11 conforms to the inner spherical surface or stop 8 of housing 10. Likewise, the exterior surface of section 11*b* conforms to the inner spherical surface or stop 7 of housing 10. Surfaces or stops 7 and 8 provide means for limiting platform motion during acceleration and deceleration which is occasioned by cannon launching. Specifically, the rear spherical nesting stop 7 provides limit stops at launch and the forward spherical nesting stop 8 provides limit stops at rebound.

Platform torquers 12 are variable permeance devices characterized by a constant torquer current scale factor over the range of large angular excursions experienced by the gyro platform. Physically, four pole pieces 12 are disposed at 90° intervals around the platform. A pair of core and coil assemblies 12*a* spaced 180° apart are electrically connected to produce the desired torque around a single axis. Torquing about either the X or Y axis is achieved by applying electrical current to the suitable coil assemblies.

In one mechanization a magnetic core (not shown) is formed in a modified U approximately one-fourth inch thick with the pole faces shaped to conform to the spherical platform. The two coils are wound around the center section of the U. Each pole face is designed to be approximately equal to the maximum torquer excursion. The pole pieces are also separated by a distance equal to the maximum torquer excursion.

At gyro null, the relative position of the platform with respect to the stator is such that one half of each stator pole face is covered by one half of the platform magnetic hemisphere. At positions other than gyro null, the gradient of energy stored in the rotor-stator gap, $h$, gives rise to a force in the tangential direction thereby applying a torque to the rotor. The degree of overlap, $Y$, is a function of the instantaneous angular displacement of the rotor. The gap, $e$, between the pole faces and platform is many times smaller than other gaps in the assembly so that most of the magnetomotive force (MMF) is concentrated between the pole faces except for leakage flux which will offset the considerations for saturation.

Torque is proportional to current. This will be a requirement on the rotor-platform torquer where the torquer current will be measured to determine rate. However, for the platform-vehicle torquer, linearity is not a requirement and so some power can be saved by eliminating the control winding and accepting torque proportional to $i^2$ or power. For this type of torquer, flux leakage and therefore scale factor is dependent on angular position. Therefore, the gyro-platform approach has an advantage since the torquer requiring precision, the rotor-platform torquer, operates under very small angular requirement while the torquer not requiring precision, the platform-vehicle torquer, is the one which operates under large angular excursions.

The platform pickoff (not shown) is of the differential reluctance type. Physically, the stator and windings of this pickoff are similar to those of the torquers. This results in a considerable reduction in design and manufacturing cost, and simplification of the unit. Each platform stator is wound with two coils. When the primary coil is excited with an ac current, an ac flux flows in the magnetic curcuits. This flux passes through the stator out one pole face, through the return path (in this case the platform) and back into the stator through the other pole face. This ac flux links the secondary coil on the stator and induces an EMF across it.

In the gyro, two stator poles 33*a* and 33*b* are disposed opposing one another at the equatorial diameter inside the gyro cavity. The two secondaries are connected in opposition so that the net voltage is proportional in amplitude and phase to the amplitude and phase of the rotor displacement. The signal voltage is generated in each secondary by Lenz's law. The amplitude of this voltage is proportional to the peak flux value. This in turn is porportional to the MMF in the primary and the reluctance in the magnetic path. The MMF in the primary path is held fixed. Assuming that the reluctance in the circuit is in the air gaps, then, the output voltage is porportional to the reciprocal of the reluctance, or the permeance of the gap. The permeance is:

$$P = \frac{\mu A}{h} = \frac{\mu a y}{h}$$

where $P$ = Permeance
$A$ = Area of Pole Faces
$h$ = Gap
$\mu$ = Permeability of the Gap Medium
$a$ = Width of Pole Faces
$y$ = Overlap of Pole Faces Therefore, it is seen that the output voltage of an individual pickoff stator is directly proportional to the rotor deflection. The differential output is twice as sensitive as the individual outputs, and also rejects many common mode effects.

The gyro rotor 25 is free to spin about axis 1 inside the platform, but its angular excursions within the platform are kept very small (e.g., 1°–2° ) through a loop that maintains the gyro rotor captured relative to the platform. A hysteresis ring 34 made of magnetically permeable material is mounted interiorly of the gyro rotor facing the stators. It serves as the moveable element of the zero torquers, the gyro pickoff, and the wheel sustaining motor 33 consisting of stators 33*a* and 33*b* and hysteresis ring 34. Pickoffs (not shown) mounted on the stators 33*a* and 33*b* and also made of magnetically permeable material measure the angular displacement of hysteresis ring 34 in relation to the stators. Also affixed to the gyro rotor is a combination spin-up and inertia rim 29 made of a dense material and located exteriorly at the equator of the rotor. Buckets 29*a* are machined into this rim and at spin-up a volume of high pressure gas from passage 48 (as shown) in FIGS. 3 and 4) is impinged upon these buckets, causing the complete gyro assembly to spin up to within 10% of the desired operating speed within 100 milliseconds.

The gyro drive consists of synchronous hysteresis motor 33, operating at a constant speed. The choice of a synchronous motor allows the simplest motor design with just a hysteresis ring mounted on the rotor, and a stator supported by the platform. A curved surface provides a constant gap, $h$, between the hysteresis ring and the stator laminations. The stator construction minimizes the variations in the height of the stator laminations, allows a minimum gap between rotor and stator, and provides a slot for the pickoff and torquer windings.

The gyro pickoffs are of an ac electromagnetic design based on the variable reluctance principle one pickoff is provided on each of the two gyro-sensing axes, each consisting of two coils wound directly on the motor poles. The motor coils 33*d* and 33*d* act as the primary for the variable reluctance transformer. The position of the spinning hysteresis ring relative to the two stator stacks determines the reluctance of the magnetic path for each pickoff coil. The difference between the two voltages induced in the pickoff secondary indicates the position of the gyro rotor relative to the stator assembly. The gyro torquer windings are designed on the same basis as the pickoffs, using the variable reluctance principle, but with dc excitation. The windings are located on the motor poles opposite the pickoffs. When the current in one coil exceeds that in the other, a force is excited on the hysteresis ring, attracting it towards the pole center of the higher current coil. This force causes precession in the other gyro axis and, in this manner, allows torquing control to be accomplished. In the balanced state, the currents in the two torquer coils are exactly equal, and no precession torques are applied. When torquing is desired, the current in one coil is increased and the current in the other is decreased by the same amount, thus providing a torquing rate that is directly proportional to the control current.

As stated above, rotor 25 has very limited angular freedom relative to platform 11. For this purpose three limit stops 47 are placed 120° apart around the base of the gyro rotor. Because of this limited angular freedom, excellent gyro performance, especially torquer linearity, bias drift and restraint levels can be expected. Regardless of the angular movement of the platform, the rotor is slaved to remain in a fixed orientation relative to the platform. The pickoffs between the platform and the gyro element is used to maintain the gyro at null relative to the platform.

The nose section of housing 10 has a transparent dome-shaped window 9 through which radiations are received by the optical system. A circular filter lens 3 for selectively passing radiant energy in the desired range is mounted in a circular groove 3*a* formed at an assumed North pole of platform 11. Filter lens 3 is positioned on platform 11 directly behind dome-shaped window 9 of housing 10. A lens holder portion 26 of the gyro rotor supports optic focusing lenses 27 and 28 which are positioned behind filter lens 3. The lens holder 26 is formed on the gyro in such a manner that the optical axis 2 of the lenses is displaced from but maintained parallel to the spin axis 1 of the gyro. The effect of this displacement is to have the image of the target describe a circle on the detector plane as the gyro rotates. The detectors 41 and 42 and cryostat assembly 43 are surrounded by the gyro cavity and fixedly mounted at an assumed South pole on the pedestal 50 of the platform 11. The detectors and cryostat assembly are in coaxial alignment with the spin axis 1 of the gyro and are partially enclosed within a cylindrically shaped member 45. Cylinder 45 supports stator windings and motor 33 in alignment with hysteresis ring 34. Flex tape 46 also located on cylinder 45 conducts current to the electronics (not shown) and to terminals 31*a* and 31*b*. The opening 51 of cylinder 45 may be enclosed by a filter 40. This filter may be an alternate location for lens filter 3. The cryostat 43 is centrally located in the cylinder and positioned above the cryostat are laser detector 41 and infared detector 42. Separate detectors are preferable in this environment because of the spectral range of the two types of signals to be detected.

A cryostat gas and platform caging mechanism 49 performs the functions of caging the platform and bringing high pressure gas to the cryostat assembly for cooling. Mechanism 49 comprises a rod or piston 49*a* situated inside of a chamber 49*c* which is formed in base 16. Chamber 49*c* has end plug 90 and seals 91, 92 and 93 to prevent gas leakage. The forward end 49*d* of piston 49*a* is inserted in bore 11*c* of platform 11 and by this means cages platform 11. The gas for cooling the cryostat assembly is needed before gyro spin-up but not during gyro operation. To accomplish this passage 49*b* within piston 49*a* conducts cooling gas to cryostat assembly 43. The high pressure gas (approx. 6000 psi) enters through the opening of 49*f* marked "cryostat gas in." The opening 49*g* marked "release gas in" is pressurized to some nominal value (approx. 30 psi). When the gas pressure in chamber 49*c* falls below 30 psi, the pressure of the gas from passage 49*g* acts on piston 49*a* from above and propels rod 49*a* downward away from platform 11, releasing or uncaging it.

Turning to FIGS. 1, 5 and 6, pedestal 50 may be formed of a block of material plugged into the hole at the South pole of platform 11. Pedestal 50 has legs 51 and 52 depending exteriorly of the platform into which are inserted two arms 53*a* and 53*b* of a member 53 which has the shape of a cross. Arms 53*a* and 53*b* are free to pivot in holes 51*a* and 52*a*. A sleeve member 54 also shaped in the form of a cross has an inner diameter greater than member 53 over which it is fitted. Arms 54*a* and 54*b* of sleeve member 54 are positioned intermediate legs 51 and 52. Arms 53*c* and 53*d* of member 53 extend through the arms 54*c* and 54*d* of sleeve member 54. Attached for rotation about arms 53*c* and 53*d* of member 53 is expansible member 57. Member 57 is also attached for rotation about another cross shaped member 59 and sleeve 61. Member 61 is inserted over shaft 59 leaving the arms 59*a*, 59*b*, 59*c* and 59*d* exposed. The bottom end of expansible member 57 is attached to arms 59*c* and 59*d* respectively. Arms 59*a* and 59*b* are in turn attached to base members 62 and 63 and rotate in holes 62*a* and 63*a* respectively located at the tip of base members 62 and 63. Base members 62 and 63 are attached to the vehicle. Member 57 has telescopic inner tubular member 57*a* and 57*b* respectively which permit member 57 to expand as it is rotated about its pivot points. Flex tapes 64 and 65 attached to member 57 conduct electrical signals from the base to the electrical circuits of the gyro seeker. The flex tapes 64 and 65 expand with the expansion of member 57. As seen in dotted outline in FIG. 5, member 57 rotates about arms 53*c* and 53*d* and 59*c* and 59*d* to an angle commensurate to within 25° of platform freedom. As shown in the dotted outline in FIG. 6, the angle of rotation in the other plane of the trapeze mechanism about pivot points 53*a*, 53*b*, 59*a* and 59*d* is similar. The trapeze mechanism defines axes about which the platform is moveable and also provides a means through which gas can be brought to the gyro gas bearings orifices by way of passages 48. The trapeze mechanism also keeps the platform from rotation which may be caused by the drag of the rotating gyro element.

The platform, gyro, optical assembly, and detector and cryostat assembly are a balanced system. The center of gravity of this combined mass is coincident with the center of suspension as defined by the upper spherical gyroscope bearing surface 25*a*.

Figure 7:
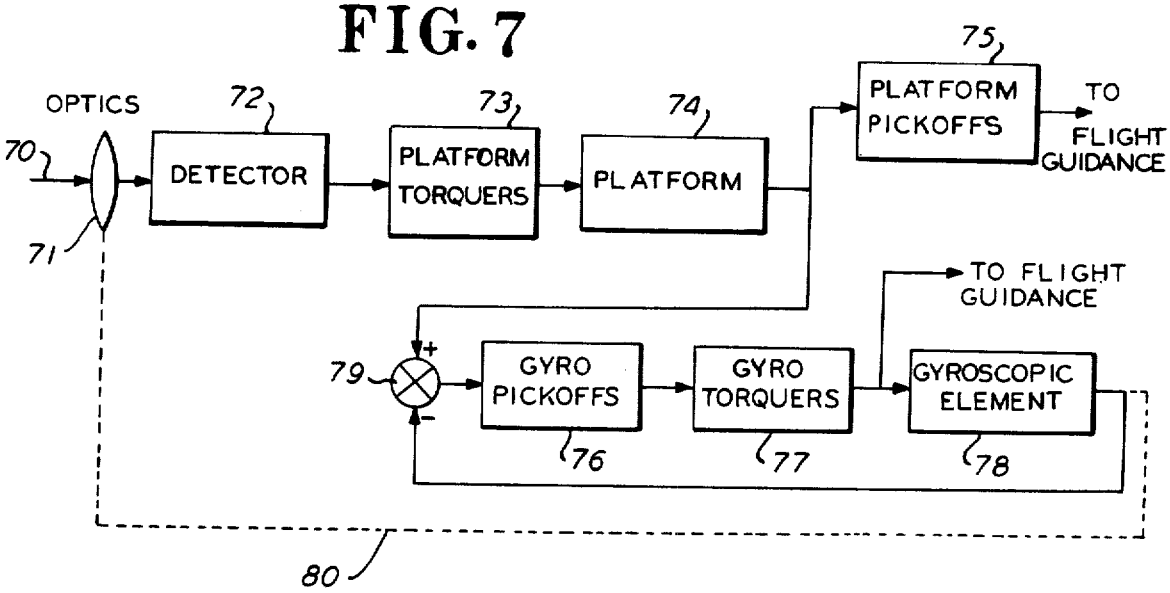
FIG. 7 is a block diagram showing platform function.

FIG. 7 is a block diagram showing platform function. Received radiation 70 is focused by optics 71 onto the detector 72. The direction of the radiation relative to the instrument is determined in detector 72 and a signal representing the deviation of the target signal from the optical axis is applied to the platform torquer 73. The platform torquer applies torques to the platform 74 in such a manner as to point the platform towards the source of radiation. As the platform 74 is re-oriented in inertial space, the gyroscopic element 78 remains stationary until it receives the torques required to displace it. As the platform 74 is torqued, the gyro pickoffs 76 sense an angle between the platform 74 and gyroscopic element 78. In response to this angle, the gyro torquers 77 deliver torque to the gyro, thereby maintaining it at null. Summing network 79 accomplishes the nulling. The gyro torquing currents and the platform pickoff voltages are delivered to the flight guidance for signal processing. Dotted line 80 indicates that the gyroscopic element and the optics are one and the same.

The torquer required to precess the gyroscopic element acts between the gyro and the platform's torquer. It therefore never has to contend with a requirement for wide angle operations. This permits precision torque quantization through measurement of the electrical torquing function (i.e., current). This torquer is an electromagnetic pickoff and gyro rotor sustainer.

As seen above, two separate pickoffs are required for platform mechanization. The gyro readout pickoff 76 is virtually identical to the platform's torquer 73. The gyro pickoff used in the variable reluctance mode has demonstrated performance compatible with angle readout requirement. The gyro pickoff is in essence an E-bridge type device in which reluctance assymmetry induced by angle causes an impedance mismatch in opposed coils. The performance of the pickoff is not critical in terms of linearity. However, a reasonable stable null is required.

In operation, the wide angle gyro seeker can acquire a target which is designated by a laser designator or one which is emitting radiant energy. Ground targets such as buildings, tanks, jeeps, etc., would most likely be the types of laser designated targets. While aircraft emitting sufficient radiation (i.e., heat) would most likely be the targets sensed by radiation.

As previously stated, the dual mode detector of the invention is capable of detecting both laser frequencies and frequencies of radiation from aircraft. The optics of the device are such that both types of radiation are focused on their respective detectors, the infared radiation passing through the laser detector virtually unattenuated. As noted above, the optics are affixed to the gyro-element in such a manner that the optical axis 2 is parallel to the spin axis 1 of the gyro but is displaced from it. As the gyro rotor rotates, the image of the target that is formed in the detector plane is focused on their respective detectors, and describes a path whose locus is a circle and the radius of this circle is equal to the displacement of the optical axis from the gyro spin axis 1. The location of this circle in the image plane is a measure of the angular displacement of the target from the gyro axis. If the target has moved off the optical axis, then the gyro and the platform supporting the gyro are both torqued towards the target.

Since the gyro assembly is required to operate at angles through ± 25° and because a desire for maximum sensitivity requires that the image plane of the optics remain in the detector plane independent of input angle, it becomes necessary to torque the detector along with the optics. However, the detector and cryostat assembly must be kept decoupled from the optical assembly in the sense that the optics spin relative to the detector. In order to obtain the required detector sensitivity it is necessary that the cryostat be used to cool the detector. This cryostat must also move along with the optics and detector and thus must either be attached or servo locked to the gyro body. The combination of the detector and cryostat assembly is servo locked to the gyro element thereby effecting a two axis inertial platform.

The gyro detector assembly operates as follows. As the vehicle is moving in the direction of the target a command from the missile control system brings the gyro element up to speed by discharging a high pressure gas bottle (not shown) at the spin-up buckets in the inertia rim. As the rotor reaches the speed of about 35 Hz, the control loop between the platform and gyro is activated. This loop measures the location of the rotor relative to the platform. At the same time, the hysteresis motor is operated so as to maintain the rotor speed at 50 Hz. When the rotor is nulled, cooling gas is passed in to the cryostat via passage 49*b*. Assuming that the target has been detected and is maneuvering, the gyro optical assembly will continue to point at the target. As the target moves off optical axis 2, this motion is detected by detector 41 and its associated circuitry (not shown). The direction of the target relative to the optical system is resolved so that the platform torquers 12 are called upon to torque the platform in the proper direction to have it pointing at the target. As the platform is torqued and therefore moved in inertial space, the gyro element remains stationary since it is a gyro. When this happens, an angle is developed between the gyro element and the platform. The gyro torquer loop will not allow this angle to exist and will torque the gyro to keep it at platform null. The current required to maintain the gyro at platform null is a measure of the platform rate in inertial space and is, therefore, a measure of the target line of sight rate relative to the vehicle.

From the foregoing a dual mode gyro seeker has been described. While a particular embodiment of the invention has been shown and described, modifications may be made, and it is intended in the following claims to cover the embodiments which fall within the true spirit and scope of the invention.

What is claimed is:

1. A two degree of freedom wide angle gyro seeker for use with a cannon launched missile which missile includes a nose section adjacent to a fixed base portion comprising:

a. a housing having a transparent dome shaped window at its forward end for admitting radiation and adapted to be positioned over the nose section of a missile;

b. a platform disposed for angular movement, mounted in said housing;

c. an optical assembly having a longitudinal optical axis;

d. a gyro carrying said optical assembly mounted interiorly of said platform and positioned behind said window, the rotor of said gyro establishing a spin axis about said optical assembly;

e. a detector mounted rearwardly of said optical assembly, said detector being positioned in coaxial alignment with the spin axis of said gyro;

f. means for maintaining said optical assembly with its longitudinal optical axis perpendicular to the plane of said detector while moving said platform through its angular limits; and g. means for displacing said optical assembly's optical axis a predetermined distance from but parallel with said gyro spin axis so that as the rotor rotates, an image of a target is formed on the detector plane that describes a path the locus of which is a circle and the radius of which circle is dimensionally equal to the displacement of the optical axis from the gyro spin axis and the distance of the center of said circle from the intersection of said gyro spin axis with said detector is a measure of the angular displacement of the target from the gyro axis.

2. The apparatus of claim 1 comprising:

a detector for detecting targets radiating rays in the infrared range, and a detector for detecting a source of reflected laser energy.

3. The apparatus of claim 2 comprising:

a cryostat for cooling said infrared detector to enhance the sensitivity of said detector.

4. The apparatus of claim 3 comprising:

an enclosure means for said detectors and cryostat said enclosure means being fixedly mounted on said platform.

5. The apparatus of claim 4 comprising:

means for permitting an angular freedom of said platform of at least ± 25° along two axes.

6. The apparatus of claim 5 comprising:

a trapeze mechanism mounted in said housing for pivoting said platform along two axes, means in said trapeze mechanism for conducting spin-up gas to said gyroscopic element, and means for caging said platform during transport and launching of said gyro seeker.

7. The apparatus of claim 6 comprising:

means cooperating with said caging means for supplying cooling gas to said cryostat, and means on said platform cooperating with the inner surfaces of said housing for permitting said platform to withstand the high gravitational forces of cannon launching.

8. The apparatus of claim 7 comprising:

forward and rear spherical surfaces on said platform for nesting in the adjacent spherical surfaces of the base of said missile whereby said platform is able to withstand high induced acceleration forces during cannon launching.

9. A dual detection gyro seeker gyro system for a missile having a base and a nose section adjacent said base comprising:

a. a housing having a nose shaped to fit over the nose section of the missile;

b. a glass dome in the nose of said housing to permit target reflections and light to enter the housing;

c. an optical assembly having a longitudinal axis, situated in said housing for focusing acquired targets and light onto an image plane, d. a cryostat assembly mounted in said housing having its longitudinal axis parallel to the longitudinal axis of said optical assembly but displaced thereform;

e. a detector situated in said image plane; for movement and hydrostatic support in a manner providing housing, supporting said optical system and having its spin axis in coaxial alignment with the longitudinal axis of said cryostat, the rotor of said gyro rotating about said cyrostat while said cryostat remains fixed;

g. a motor for sustaining the rotation of said rotor;

h. a spherically shaped hydrostatically mounted platform within said housing, said gyro being supported on its hydrostatic bearings within a spherical cavity formed inside said platform and said cryostat being supported on a pedestal fixed to said platform and passing through to the inside cavity of said gyro;

i. means for torquing said rotor and for deriving angular movement of said rotor; and j. means for torquing said platform, whereby said optical assembly's optical axis and said detector are always maintained perpendicular to each other and said system is rendered capable of detecting designated and acquired targets.

* * * * *